US007382275B2

(12) United States Patent
Feldman et al.

(10) Patent No.: US 7,382,275 B2
(45) Date of Patent: Jun. 3, 2008

(54) MOBILE ENFORCEMENT READER

(75) Inventors: Ira R. Feldman, Yorba Linda, CA (US); Paul A. Moosie, Mississauga (CA); Brian E. Patno, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 191 days.

(21) Appl. No.: 11/206,553

(22) Filed: Aug. 18, 2005

(65) Prior Publication Data

US 2006/0044161 A1 Mar. 2, 2006

Related U.S. Application Data

(60) Provisional application No. 60/606,328, filed on Aug. 31, 2004.

(51) Int. Cl.
*G08G 1/00* (2006.01)

(52) U.S. Cl. ..... 340/904; 340/426.16; 340/426.17; 340/902; 340/928; 340/933; 342/367; 342/423; 342/445; 705/13

(58) Field of Classification Search ..... None
See application file for complete search history.

(56) References Cited

U.S. PATENT DOCUMENTS 4,296,400 A * 10/1981 Becker Friedbert et al. 340/989
4,303,904 A * 12/1981 Chasek ..... 235/384
4,740,045 A * 4/1988 Goodson et al. ..... 342/112
5,278,563 A 1/1994 Spiess
5,289,183 A 2/1994 Hassett et al.
5,530,447 A * 6/1996 Henderson et al. ..... 342/70
5,652,589 A * 7/1997 Ono et al. ..... 342/70
5,657,008 A 8/1997 Bantli
5,767,505 A 6/1998 Mertens et al.
6,052,068 A * 4/2000 Price R-W et al. ..... 340/933
6,081,206 A 6/2000 Kielland
6,163,277 A * 12/2000 Gehlot ..... 340/905
6,191,705 B1 2/2001 Oomen et al.
6,359,570 B1 3/2002 Adcox et al.
6,388,579 B1 * 5/2002 Adcox et al. ..... 340/902

(Continued)

FOREIGN PATENT DOCUMENTS

DE 101 26 345 A1 1/2001

(Continued)

OTHER PUBLICATIONS

Proposal for MnPass Project, Submitted to Minnesota Department of Transporation Sep. 2, 2003, 3 pages.

(Continued)

*Primary Examiner*—George Bugg
*Assistant Examiner*—Son Tang
(74) *Attorney, Agent, or Firm*—Daly, Crowley, Mofford & Durkee, LLP

(57) ABSTRACT

A mobile enforcement reader (MER) includes an antenna, a reader coupled to receive signals from the antenna and a control/display unit (CDU) coupled to the reader. The CDU selects a receive direction and processes signals provided thereto from the reader. When the MER and a transponder are in proximity, the MER interrogates the transponder and receives information related to toll payment. The MER allows enforcement officials to monitor payment by single occupancy vehicle (SOV) traffic for use of high occupancy traffic (HOT) lanes.

17 Claims, 4 Drawing Sheets

U.S. PATENT DOCUMENTS

| | | | | |
|---|---|---|---|---|
| 6,408,232 | B1 * | 6/2002 | Cannon et al. | 701/29 |
| RE38,626 | E | 10/2004 | Kielland | |
| 6,801,138 | B2 * | 10/2004 | Koike | 340/902 |
| 7,091,821 | B2 * | 8/2006 | Lessard et al. | 340/5.61 |
| 2004/0201539 | A1 * | 10/2004 | Yewen | 343/867 |
| 2005/0280508 | A1 * | 12/2005 | Mravca et al. | 340/10.2 |
| 2006/0022800 | A1 * | 2/2006 | Krishna et al. | 340/10.2 |

FOREIGN PATENT DOCUMENTS

| | | |
|---|---|---|
| WO | WO 98/49654 | 11/1998 |
| WO | WO 02/63830 A2 | 2/2002 |
| WO | WO 02/63830 A3 | 2/2002 |

OTHER PUBLICATIONS

"MnPass Project;" submitted by the Partnership Team of Wilbur Smith Associates; SRF Consulting Group, Inc.; Raytheon Company; Cofiroute Global Mobility; submitted to Minnesota Department of Transportation; Sep. 9, 2003.

International Search Report for application No. PCT/US2005/029360 dated Dec. 22, 2005.

International Search Report for application No. PCT/US2005/029405 dated Dec. 14, 2005.

Written Opinion for the ISA for Application No. PCT/US205/029360, Dec. 30, 2005.

Written Opinion for the ISA for Application No. PCT/US205/029405, Dec. 27, 2005.

* cited by examiner

MOBILE ENFORCEMENT READER

CROSS-REFERENCE TO RELATED APPLICATIONS

This application claims the benefit under 35 U.S.C. §119 (e) of U.S. Provisional application Ser. No. 60/606,328 filed Aug. 31, 2004, which application is incorporated herein by reference in its entirety.

STATEMENT REGARDING FEDERALLY SPONSORED RESEARCH

Not Applicable.

FIELD OF THE INVENTION

This invention relates generally to systems and techniques for signaling of an enforcement agent and more particularly to signaling of an enforcement agent proximate a vehicle in a toll zone.

BACKGROUND OF THE INVENTION

As is known in the art, a toll road is a road on which an agency (either a private agency or a public agency) collects money from users who wish to drive vehicles on the road. Typically, users pay a toll at so-called toll booths located at toll plazas which are established at certain locations along the road. The tollbooths sometimes include a gate which prevents a vehicle from passing through the toll booth unless a toll is paid. Once the toll is paid, the gate is raised to allow the vehicle to pass. Thus, to pay the toll at the tollbooth, the driver typically slows down the vehicle (or stops the vehicle if the toll booth has a gate) at the tollbooth and either pays a person acting as a toll collector or deposits money in a collection bin which registers payment of the toll.

As is also known, there is a trend on toll roads to automate the collection of the toll. Some automated toll collection systems allow electronic payment of the toll. To allow such automated electronic toll payment, users who wish electronically pay the toll place a transponder in their vehicle (sometimes referred to as a "toll transponder"). The vehicle transponder communicates with one or more reader systems which are mounted at predetermined locations (typically at toll plazas) along the toll road. Such automated toll systems do not require any gates, barriers or any physical impediments to free traffic flow on the highway. With this technique, tolling can be accurately and reliably conducted substantially at highway speeds (i.e. vehicles having transponders mounted therein need not slow down significantly for the toll to be collected).

In particular, on certain roadways, single occupancy vehicle (SOV) users are permitted to use the high occupancy toll (HOT) lanes if they use a Dedicated Short Range Communications (DSRC) transponder (also sometimes referred to as a toll transponder) to pay the appropriate toll posted at a toll gate which may, for example, be located at the vehicle's point of entry on the road. Thus, automatic toll collection systems do not require any toll plazas, gates, barriers or any physical impediments to free traffic flow on the highway. Furthermore, tolling can be accurately and reliably conducted at or near highway speeds.

It is possible, however, for an SOV driver to use the HOV lane but to either not have an approved transponder, or to hide or shield the transponder to avoid having the toll collected. It would, therefore, be desirable to provide a system and technique which can detect these situations.

SUMMARY OF THE INVENTION

In accordance with the present invention, a mobile enforcement reader (MER) includes an antenna, a reader coupled to receive signals from the antenna and a control/display unit (CDU) coupled to the reader. The antenna is adapted to receive signals from transponders in vehicles traveling along a roadway. The CDU receives signals provided thereto from the reader, processes the signals and provides an output signal to a user. The output signal may be in the form of an audio signal, a visual signal or a mechanical signal.

With this particular arrangement, a mobile reader for placement in one vehicle to read information from a transponder (e.g. a toll transponder) disposed in another vehicle is provided. The MER thus provides a reader function on a mobile or portable platform. The MER allows enforcement officers to remain in their vehicles and receive information from transponders in other vehicles anywhere along a roadway. The enforcement vehicle can be stationary or traveling at highway speeds while receiving information from transponders in other vehicles. Likewise, the other vehicles can be stationary or traveling at highway speeds (i.e. both vehicles can be moving or both vehicles can be stationary or either one of the vehicles can be moving and the other stationary). The MER thus uses vehicle-to-vehicle reader capability (or perhaps more accurately, MER to vehicle transponder capability) to read transponder information within a subject vehicle as it moves proximate the vehicle containing the MER (e.g. an enforcement vehicle). This offers a non-intrusive means for monitoring and/or verifying toll collection from transponders in a vehicle traveling along a road. This also offers a non-intrusive means for determining the presence of a properly functioning transponder in a vehicle. Thus, in the case of a single occupancy vehicle (SOV) traveling in a high occupancy toll (HOT) lane, an enforcement vehicle having a MER can check the transponder in the SOV by traveling proximate the SOV and allowing the MER to read information from the SOV transponder via a communication path between the MER and the SOV transponder. In the case in which the transponder is a Type II transponder (e.g. a read/write transponder), the MER can receive information such as the amount, time and date a toll was last paid by the SOV transponder. The MER can thus be used by an enforcement officer to verify whether a vehicle which is (or was) proximate an enforcement vehicle containing the MER has been properly tolled. In the case in which the transponder is a Type 1 transponder (i.e. a read only transponder), the MER can read information stored in the transponder such as, transponder type, a transponder identification, etc . . . .

In some embodiments, the antenna is adapted to receive signals from a plurality of different directions and the CDU is adapted to select a MER antenna receive direction. Thus the MER can also include a direction selector, a display and a CDU processor. The direction selector is adapted to select the direction from which the MER will receive transponder signals. For example, if the vehicle of interest is behind an enforcement vehicle containing the MER, then the direction selector can be used to configure the MER to receive transponder signals behind the enforcement vehicle (and thus behind the MER). On the other hand, if the vehicle of interest is to the left or right of the enforcement vehicle, then the direction selector can be used to configure the MER to receive transponder signals from either of those directions. In still other embodiments, the direction selector can be used to configure the MER to receive transponder signals from in front of the MER. The CDU provides to the user (e.g. an enforcement officer driving an enforcement vehicle) information read from a transponder. The CDU display can, for example, be provided as a touch screen of a personal digital assistant (PDA). The CDU display can also utilize visual, audio and mechanical output signals to alert a MER user of a particular condition. The MER CDU is thus adapted to permit safe and easy operation while driving.

In one embodiment, upon a successful read of a transponder, the MER displays the date, time and location of the last time the transponder was detected by an Electronic Toll Collection (ETC) system. This information permits an enforcement agent (e.g. a police officer or other safety officer) to determine whether an SOV driver was using the transponder properly or whether the SOV driver was committing a violation by either not paying a toll or by using an invalid transponder or because of some other reason. It should be appreciated that other enforcement or toll related information may also be displayed or otherwise communicated by the MER to a user.

The reader is coupled to a CDU processor. The CDU processor is adapted to process information received from transponders and also to recognize a plurality of classes of transponders. The CDU processor can include a storage device adapted to store information provided to the reader from a transponder. With this particular arrangement, a mobile enforcement reader adapted to receive information from a first transponder and to transmit the information to a second different transponder or reader (including a second different MER or other device) is provided. Once the MER receives and stores information from the first transponder, the MER can transmit the information to a second different transponder or reader or other device via the TR system.

In some embodiments, it may be desirable to store transponder type classification data can be stored on the transponder and/or on the MER in a transponder type data store. The transponder is classified according to the data stored in the transponder type data store. For example, if the data store holds an enforcement class data value, then the transponder is recognized as an enforcement class transponder by an appropriately programmed MER.

In response to a signal received from a transponder, the MER can identify the transponder as belonging to at least one of a plurality of transponder classes. Depending upon the transponder class, the MER then transmits or otherwise provides certain information to the transponder. In those applications in which the second transponder corresponds to an enforcement class transponder disposed in a law enforcement vehicle, the MER enables an enforcement agent to receive information related to a vehicle of interest having a transponder which communicates with the reader.

In accordance with a still further aspect of the present invention a MER includes a plurality of antennas each antenna having a first port coupled to a reader through a radio frequency (RF) switch. In one embodiment, the reader is provided as a dedicated short range communication (DSRC) transponder which includes a transmitter and a receiver. The transmit-receive (TR) system is coupled to a control/display unit (CDU) which includes a CDU processor and a transponder type data store which may be internal or external to the CDU. With this particular arrangement, the MER is adapted to hold transponder type classification data. The transponder type classification can be stored in the transponder type data store. The MER is classified according to the data stored in the transponder type classification store. For example, if the data store holds a mobile enforcement reader class data value, then the MER is recognized as a mobile enforcement class reader by an appropriately programmed reader.

The MER can belong to one or more of a plurality of classes in a transponder classification scheme. Transponder classification classes include, but are not limited to, an enforcement class, a mobile enforcement reader class a safety class, a toll class, a commercial vehicle class, and a government class. Depending upon the particular class (or classes) to which the MER belongs, the MER receives a certain set of information from a reader. In those applications in which the MER is disposed in a law enforcement vehicle, the MER provides a mobile enforcement system.

In accordance with a still further aspect of the present invention, a technique which allows an enforcement agent to verify that an SOV user of an HOV lane not only has a valid transponder, but that a toll was appropriately collected from the SOV user includes retrieving information from a vehicle transponder via a MER. With this particular arrangement, an enforcement officer can verify that a toll was collected without having to stop the vehicle in question.

BRIEF DESCRIPTION OF THE DRAWINGS

The foregoing features of the invention, as well as the invention itself may be more fully understood from the following detailed description of the drawings, in which.

DESCRIPTION OF THE PREFERRED EMBODIMENTS

Figure 1:
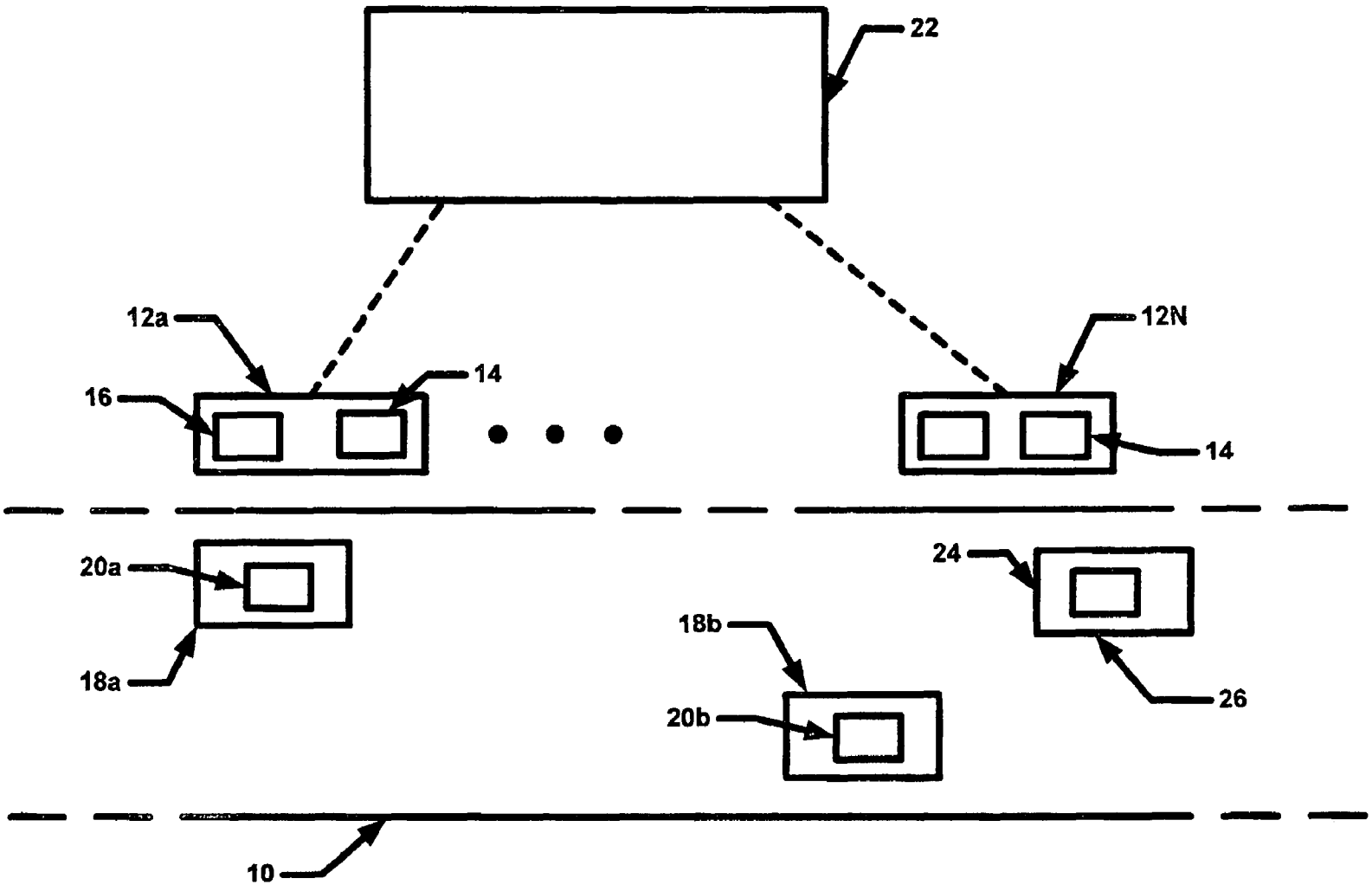
FIG. 1 is a block diagram of a toll collection system utilizing mobile enforcement readers.

Referring now to FIG. 1, a roadway 10 has one or more roadside toll collection (RTC) systems 12*a*-12N, generally denoted 12, disposed at so-called RTC sites. Although only two RTC systems 12*a*, 12N are shown in FIG. 1, a number of such RTC systems 12 are typically disposed along a road and spaced apart by predetermined intervals along the road. The RTC systems 12*a*-12N may also be disposed at or proximate particular locations along the road (e.g. proximate exit ramps, toll booths, bridge overpasses, signs, etc . . . ).

Taking RTC system 12*a* as representative of each RTC system 12, the system 12*a* includes a reader 14 adapted to communicate with vehicle equipped transponders (two such vehicles 18*a*, 18*b* with respective ones of transponders 20*a*, 20*b* being shown in FIG. 1). In the exemplary embodiment of FIG. 1, the transponders 20*a*, 20*b* correspond to so-called "toll transponders" but in other embodiments, the transponders may correspond to other types of transponders.

In one embodiment, the reader is provided as a Dedicated Short Range Communications (DSRC) transceiver which operates at a frequency of about 915 MHz and the vehicle transponders 20*a*, 20*b* may be provided, for example, as DSRC transponders compatible with the DSRC reader. It should be appreciated that the reader may be physically provided as part of the RTC system 12*a* (as illustrated by reader 14 in FIG. 1) or the reader may be physically separate from the RTC system (e.g. mounted on a mounting structure as is generally known).

The reader is an automatic vehicle identification device which includes a transmit-receive (TR) system that transmits and receives radio frequency (RF) data to/from transponder-equipped vehicles such as vehicles 18*a*, 18*b* in FIG. 1. Thus, the reader 14 communicates with transponders 20*a*, 20*b* disposed in the vehicles 18*a*, 18*b*. The reader 14 also works in conjunction with a Roadside Collectoin Unit (RCU) processor 16 to pass information read from vehicle transponders to a central computer system 22 for collection of tolls. The RTC 12*a* reads information from the transponders 20*a*, 20*b* and also stores information in the transponders 20*a*, 20*b*. Thus, information is stored (or "written to") the transponder to identify when and where toll has been collected from the transponder. Such information can be used for enforcement or other purposes.

The transponders 20*a*, 20*b* may also provide signaling to vehicle operators via lights and/or buzzers built into the transponder to indicate whether a toll has been collected.

When a vehicle (e.g. vehicle 18*a*) containing the toll transponder (e.g. transponder 20*a*) enters the toll region (which is defined by the range of the RTC system), a toll is collected from the toll transponder by the RTC 12. The reader 14 typically communicates with the toll transponder and the RTC system (and/or a central computer/toll collection processing system) to properly collect the toll and maintain a record of the toll collected from each toll transponder passing through the toll region (also referred to as a toll zone).

An enforcement vehicle 24 has a mobile enforcement reader (MER) 26 disposed therein. The MER will be described in detail below in conjunction with FIG. 2. In general overview, however, the MER can read information from the transponders in other vehicles such as transponders 20*a*, 20*b* in vehicles 18*a*, 18*b*. The MER thus allows enforcement agents to remain in their respective enforcement vehicles and still receive information from transponders in other vehicles proximate the enforcement vehicles.

In the exemplary embodiment of FIG. 1, the vehicles 18*a*, 18*b* and 24 are all assumed to be traveling at speeds consistent with the road type (e.g. in the range of about 60 mph if roadway 10 corresponds to a state turnpike or multi-lane highway). It should be appreciated however that the MER would still function properly if any or all of the vehicles were stationary. Thus, the MER provides a non-intrusive means of obtaining information from a transponder in a passing vehicle.

In one embodiment, the RTC sites serve so-called "diamond lane" segments of a roadway. Diamond lane segments are those roadway segments (e.g. one lane of a mult-lane highway) reserved for use by vehicles having more than one person therein (so-called High Occupancy Toll or HOT). However, single occupancy vehicles (SOVs) which have paid a toll are also entitled to use the diamond lane segments. The MER thus allows enforcement agents to monitor SOV traffic in the diamond lanes (also referred to as HOT lanes) to determine if the SOV traffic has paid the appropriate toll. If the SOV traffic in the HOT lanes has not paid the appropriate toll, then the enforcement agent can take appropriate action (e.g. stop the SOV user from using the diamond lane, issue citation, etc . . . ).

The transponder 20*a* in vehicle 18*a* communicates with the RTC system 14 via the reader when the vehicle 18*b* enters the toll zone. If the enforcement vehicle 24 enters the roadway, then the MER 26 can provide to the enforcement agent in the vehicle 24 information concerning the transponder 20*a*. For example, the MER can provide to the enforcement agent in the vehicle 24 information including but not limited to whether the toll transponder is valid and whether the toll was properly paid and the date and time the last toll was collected from the transponder. The MER can provide the information to the enforcement agent via a visual, audio or mechanical signal. For example, the MER can include one or more of a display screen (e.g. a display screen of a personal digital assistant or PDA), a speaker or a vibration mechanism to convey information to the enforcement agent.

By establishing RTC sites with the RTC systems, it is possible to establish toll zones (either permanent or temporary toll zones) along different portions of roadways (including but not limited to off ramps and rest areas) without erecting toll structures such as toll booths and toll gates. Thus, the system enables a technique which allows an enforcement agent to verify that an SOV user of an HOV lane not only has a valid transponder, but also that a toll was appropriately collected from the SOV user. This allows an enforcement officer to verify that a toll was collected without having to pull over the vehicle in question.

In the example of FIG. 1, the transponders 20*a*, 20*b* correspond to conventional transponders (also referred to herein as a "toll transponders"). When the vehicle in which the toll transponder is disposed enters the toll region, one of the readers 14 communicates with the transponder and typically a central computer/toll collection system 22 to properly deduct the toll and maintain a record of the toll deducted from each toll transponder passing through the toll zone (toll transponders 20*a*, 20*b* being two examples of a plurality of toll transponders which pass through the toll zone).

Each transponder may include a transponder type data store. The transponder type data store may be provided as part of the transponder or may be provided as part of the vehicle (e.g. vehicles 18*a*, 18*b*) in which the transponders are disposed. In the case in which the transponder type data store is provided as part of the vehicle (rather than as part of the transponder itself) the transponder type data store is coupled to the transponder when the transponder is disposed in the vehicle. In the case of either an external or internal transponder type data store (i.e. a data store which is external to the transponder itself or internal to the transponder), the transponder type data store has stored therein a value which represents a transponder class. The value stored in the transponder type data store identifies the transponder as belonging to a specific one or more of a plurality of transponder classes.

In the embodiment of FIG. 1, the transponder type data store has stored therein a transponder type data value which indicates that transponder 20*a* belongs to a toll class of transponders. Thus, when the reader 14 receives signals from the transponder 20*a*, the reader identifies the transponder as a toll class transponder.

The MER is typically disposed in an enforcement vehicle operated by an enforcement agent (not visible in FIG. 1) such as a police officer, a safety officer or other agent. In the example of FIG. 1, the vehicle 24 corresponds to an enforcement vehicle.

When a vehicle in which the MER is disposed approaches another vehicle having a transponder (e.g. one of vehicles 18*a*, 18*b*), the MER receives information from the transponder (e.g. one of transponders 20*a*, 20*b*). The MER can receive information including but not limited to whether the transponder in the other vehicle which transmitted the information is valid and whether the toll was properly paid.

The MER can then provide the information to the enforcement agent in the enforcement vehicle. The enforcement transponder can provide the information via a visual, audio or mechanical signal. For example, information may be displayed on an LED display or on a display screen of a personal digital assistant (PDA) or the information can be conveyed to an enforcement agent via a speaker or a vibration mechanism or other mechanical system.

In general, whenever a MER approaches another vehicle having a transponder, the MER checks the time when the last toll transponder entered the toll zone and if the toll was properly paid. This allows an enforcement officer to verify that a toll was collected without having to pull over the vehicle in question.

Figure 2:
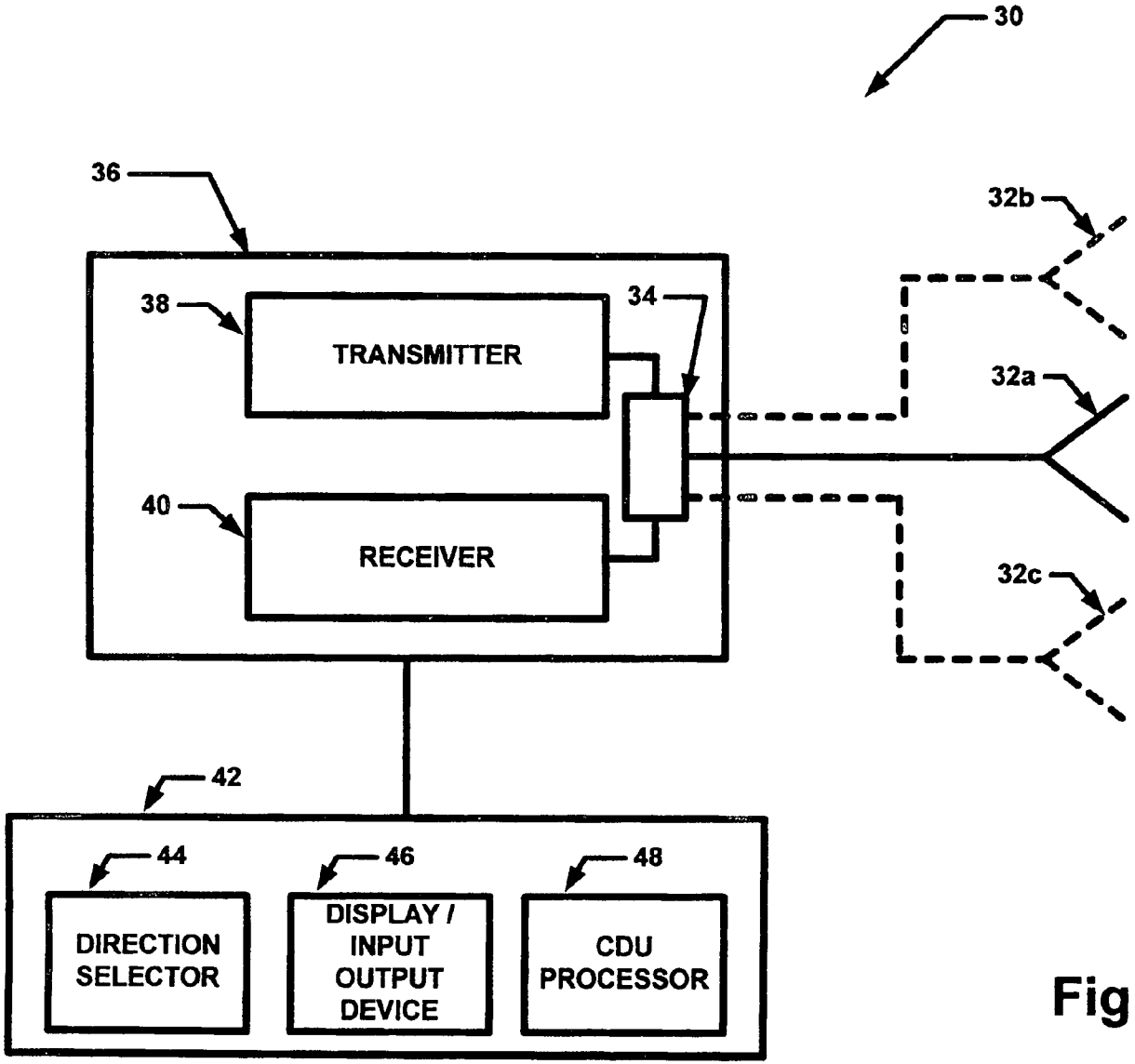
FIG. 2 is a block diagram of a mobile enforcement reader.

Referring now to FIG. 2, a mobile enforcement reader (MER) 30 includes one or more antennas 32*a*-32*c* coupled through an RF switch 34 to a reader 36 which may, for example, be provided as a DSRC transceiver. The reader includes a transmitter 38 and receiver 40 which comprise a transmit/receive (TR) system. The transmit/receive system is coupled to a control/display unit (CDU) 42 which may be provided, for example, from a processor/state machine. The CDU includes a direction selector 44, a display 46 and a CDU processor 48.

The antenna and transmit/receive systems receive signals from other transponders (not shown in FIG. 2) and provide the signals to the CDU 42. The CDU processor 48 is adapted to process signals provided thereto and recognizes or otherwise determines the classification of the transponder, if any, from the information provided thereto. The CDU processor also determines tolling information of the transponder, if any. For example, the CDU processor 48 can process transponder information to determine whether a transponder has paid a toll.

In a preferred embodiment, each of the antennas 32*a*-32*c* is pointed in a different direction. For example, antenna 32*a* may be positioned to receive signals directly behind a vehicle (e.g. behind the enforcement vehicle 24 in FIG. 1) while antenna 32*b* may be directed to receive signals on the driver side (or left side) of the enforcement vehicle and antenna 32*c* may be directed to receive signals on the passenger side (or right side) of the enforcement vehicle. In this manner the MER can be used to communicate with transponders in multiple positions about the vehicle 24.

The direction selector is used to select the direction from which the antenna (and thus the MER) receives signals from. Thus, when a vehicle in which the MER is disposed (the MER vehicle) has several vehicles in proximity, a user can select which vehicle of the several vehicles to monitor for enforcement/verification purposes (e.g. a vehicle to the left, right or behind the MER vehicle).

The calibration of the MER communication zones (also referred to as a "MER read zone" or more simply a "read zone" or a "detection zone") is performed with the CDU. The CDU controls the MER's output power level, as well as controlling the MER's receive sensitivity level.

In the calibration process, the MER receiver is set for maximum sensitivity and the power level of an output signal provided by the MER transmitter is adjusted to provide enough power for a transponder within the desired communications zone to receive the reader signal and respond with an ID message. This can be done, for example, with a calibration transponder. In one embodiment, the communications zone is set for 20 feet to allow receipt of transponder signals from a vehicle adjacent to the vehicle containing the MER. In another embodiment, the size of the communication zone is adjustable. The particular zone size to use in any application can be determined empirically.

The communications zones can be further refined by using a MER squelch adjustment to limit the range with which the MER receives signals from the transponder. This is done by sending a command to the reader to incrementally increase the squelch until the transponder is not heard anymore. This prevents the reader from picking up a weak signal that may come from a transponder other than the intended one. The squelch is adjusted to allow for signal fading. These adjustments are made to each antenna port that will be used by the MER. The calibration of the communications zone is to assure that the MER will acquire the intended transponder. The adjustable communication or read zone is described further below in conjunction with FIG. 4A.

The CDU includes a display/input-output device 46 described below in conjunction with FIG. 3.

Figure 3:
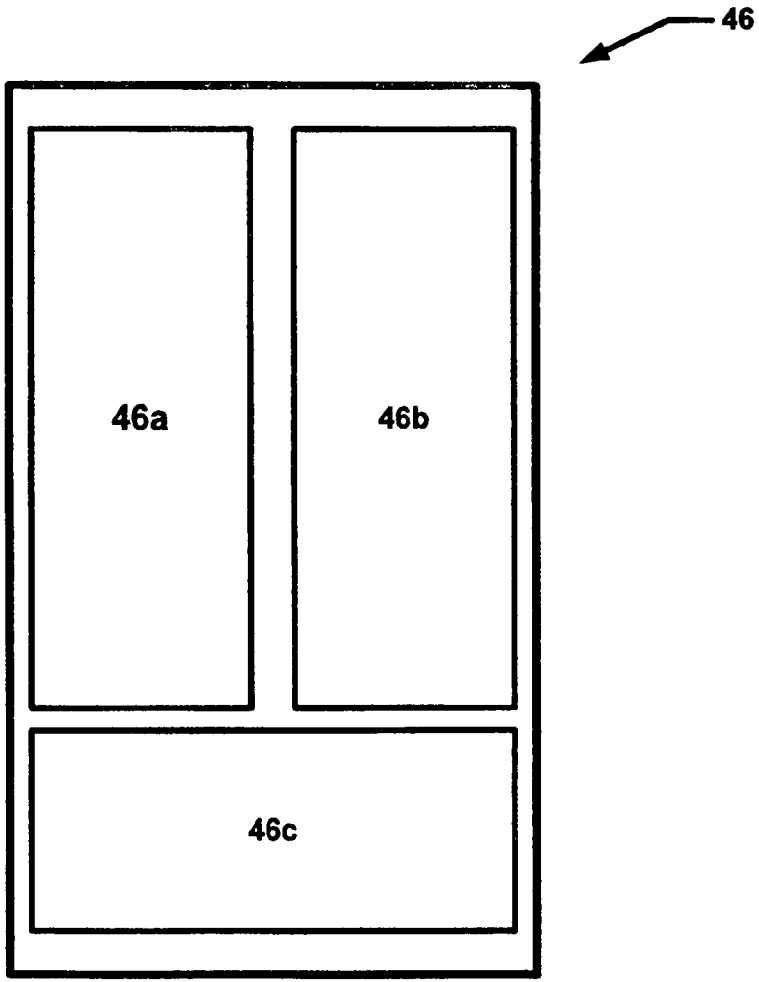
FIG. 3 is a diagrammatic view of a display for a mobile enforcement reader.

Referring briefly to FIG. 3, the control/display unit provides a visual indication of the direction of the communications zone. This particular display allows use of up to three antennas and antenna directions. The display 46 includes a pushbutton switch system such that by pressing one of the areas 46*a*, 46*b*, 46*c* shown on the display 46, the MER antenna which covers that area around the MER vehicle is engaged. For example, by pressing region 46*a* of the display 46, the antenna which covers the region to one side of the vehicle in which the MER is disposed (e.g. the left or driver's side of the vehicle) is engaged. Similarly, by pressing region 46*b* of the display 46, the antenna which covers the region to another side of the vehicle in which the MER is disposed is engaged and by pressing region 46*c* of the display 46, the antenna which covers the region behind the vehicle in which the MER is disposed is engaged. Thus, the display 46 provides a visual indicator of the direction being selected.

Referring again to FIG. 2, when acquisition is triggered (e.g. in response to the operator selecting an appropriate direction), as described above, the MER searches for any transponder within a configurable period of time (i.e. within a predetermined window of time). This search period limits the amount of time the reader is transmitting to reduce spurious emissions. As soon as a transponder is found, the reader stops searching. If a transponder is not found during the search period, the CDU displays and audibly indicates the lack of finding a transponder.

The data to be processed from the transponder comprises the Transponder ID, the location of the last toll point (as written to the transponder by a reader), the time of the last toll point that data was collected from (as written to the transponder by a reader), and agency data including the agency and vehicle classification. The data is processed to determine if transponder agency data is on the approved agency list.

If it is determined that the transponder agency data is on the approved agency list, and the transponder is not included in a so-called exception list, the transponder will be tested to see when the last time the transponder toll was collected. If this time is within a configurable time (i.e. within a predetermined window of time), the transponder is considered to be properly tolled, and the CDU will indicate the result to the operator of the vehicle in which the mobile enforcement reader is placed.

If, on the other hand, the transponder agency data is not on the approved agency list, the CDU indicates to the operator that the transponder is invalid. If the transponder's ID is on the exception list, or if the transponder was not tolled within the configurable time, the CDU indicates to the operator visibly and audibly that the transponder has not been properly tolled or has an exception, and the reason for the exception.

The exception list processing can be accomplished by an exception list processor provided as part of reader 30 and is optional to the operation of the MER. This exception list is a list of transponder IDs, along with a reason why the transponder is on the exception list. Exemplary reasons for being included on the list include but are not limited to: the transponder is reported as lost or stolen, past due accounts, or insufficient funds.

It should be appreciated that some transponders with which the MER communicates are so-called read only transponders. Read only transponders are also sometimes referred to as read only tags or Type I transponders (whereas Type II transponders correspond to read-write transponders). Thus, read only transponders have information stored therein (e.g. a plurality of different types of information including but not limited to a classification identifier) but it is not possible to write information into a memory or other data store of the read only transponder. Consequently, a MER can only read information from the read only transponder but cannot store (or write) information onto the transponder.

It should thus be appreciated that the MER can operate with any electronic device that can be used for tracking toll collection in a vehicle. This includes the above mentioned Type I transponders such as Title 21 transponders, which are read only, and Type II and III transponders which are read and write capable, such as ASTM V6 transponders.

Since the Type 1 transponders are read only, a MER cannot write or store any transaction information on the transponder. For example, a MER (or other reader) cannot store the time the transponder last paid a toll, or the time the transponder was last interrogated by a MER or other reader, etc . . . . The MER can, however, verify that the read only transponder has the correct classification for the vehicle in which the transponder is disposed. For example, if the transponder is disposed in a truck, the MER can verify that the transponders is a toll transponder for a truck verses being a toll transponder for a car.

The MER can also verify that the transponder is of a type which is accepted for use in the geographic region in which the transponder is being used. For example, if an enforcement officer is in Minnesota, a MER being used by the enforcement officer can verify that a transponder in a vehicle within range of the MER is accepted for use in Minnesota. The MER can also detect that a vehicle traveling in Minnesota has a transponder which is not accepted for use in Minnesota (even though the transponder may be accepted for use in another state). The MER can also verify that the read only transponder is not on an exception list.

Figure 4:
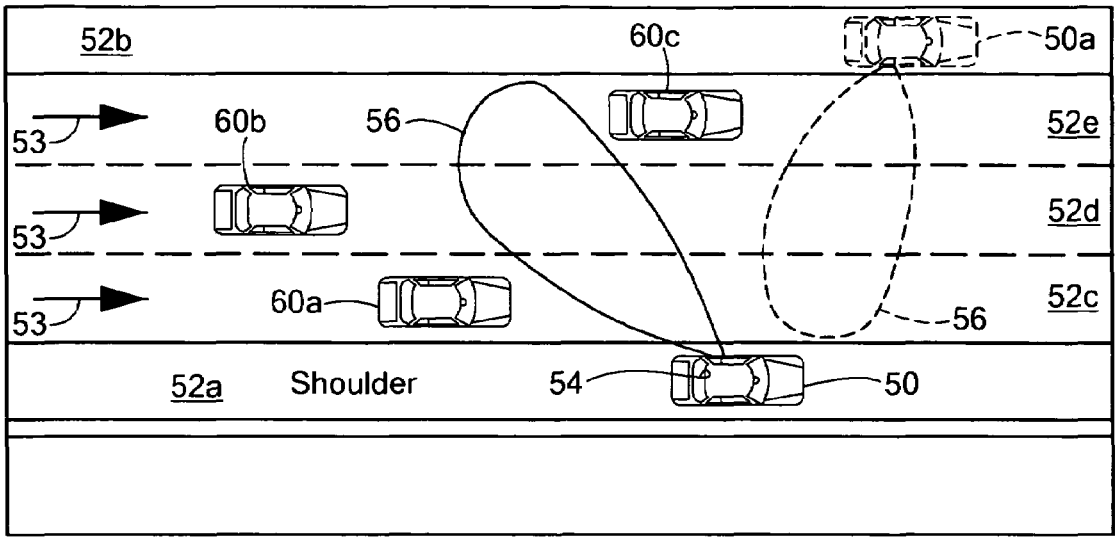
FIG. 4 is a diagrammatic view of a road having a mobile enforcement vehicle stopped on a side thereof.

Referring now to FIG. 4, a police vehicle (or other type of vehicle) 50 stopped on a shoulder of a road 52 (i.e. any portion of the road not generally used for driving) has a mobile reader and an antenna 54 mounted in or on the vehicle 50. The vehicle in which the mobile reader is disposed is referred to as the mobile reader vehicle.

The road 52 has two shoulder regions or lanes 52*a*, 52*b* and three travel lanes 52*c*-52*e*. Arrows 53 indicate the preferred direction of travel for vehicles in the travel lanes (e.g. vehicles 60*a*-60*c*). Although the road is here shown having two shoulder lanes 52*a*, 52*b* and three travel lanes 52*c*-52*e*, it should be appreciated that the MER system can be used on roads having any number of lanes ranging from a single lane road having little or no shoulder region to a multi-lane highway having six or more travel lanes and multiple lane shoulder regions.

The antenna 54 forms an antenna beam which is directed toward one or more lanes of the road 52 in a detection zone indicated by reference numeral 56. The detection zone is the spatial region in which the MER can detect a transponder. The detection zone can be provided having any desired shape or range by appropriate selection of MER antenna characteristics and detection characteristics (e.g. adjustment of squelch). The antenna may be mounted on any portion of the vehicle 50 (e.g. roof, trunk, side panel) so long as the antenna beam is not obstructed to the point where it cannot provide a desired level of performance.

The antenna is coupled to a mobile reader (not visible in FIG. 4) which is also disposed in (or on) the mobile reader vehicle 50. As mentioned above, when the mobile reader vehicle is positioned as shown in FIG. 4 (i.e. on the right side of the road) the antenna beam is directed such that it can read transponders in vehicles 60*a*, 60*b*, 60*c* which are to the left side of the mobile reader vehicle 50.

In another embodiment, the antenna can be mounted for a right-side read. An antenna mounted for a right-side read would allow the mobile reader vehicle to be parked or otherwise located on a left lane or shoulder of the road 50 (e.g. as illustrated by vehicle 50*a* shown in phantom in FIG. 4).

In the case of either a left side read antenna or a right side read antenna, a valid transponder read would produce an indication e.g. an audio sound and/or a display (e.g. on a PDA device) of the location and time the transponder was last read by a toll system.

A safety officer could also use the MER to check the status of a transponder and the last toll zone it read after a motorist was stopped, by simply placing the transponder from the motorist in front of the MER antenna. The primary advantage of this method is that an officer can enforce compliance of vehicles driving anywhere on the road 50 (not just in toll zones).

Figure 4A:
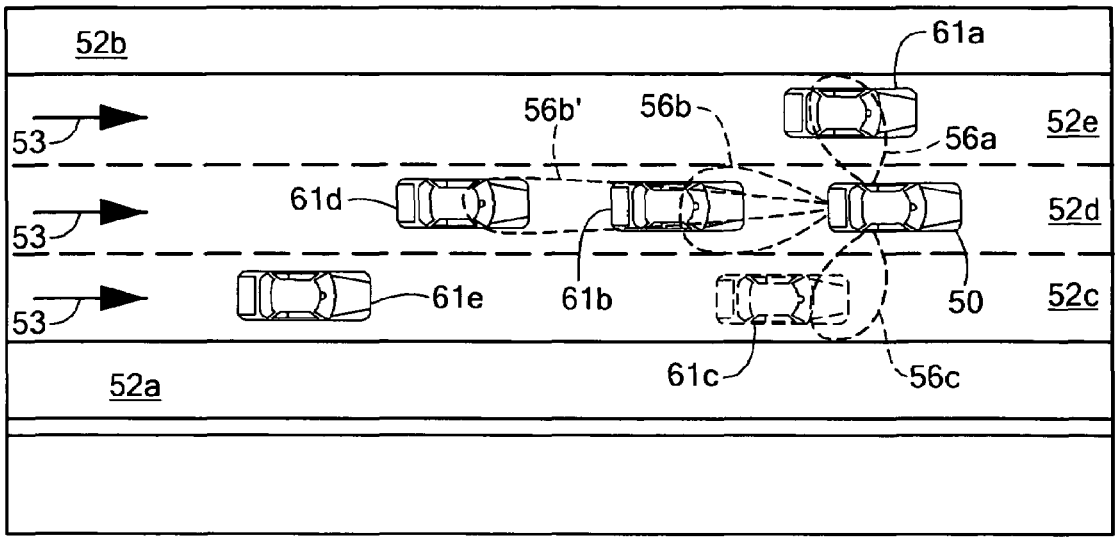
FIG. 4A is a diagrammatic view of a road having a mobile enforcement vehicle moving thereon.

Referring now to FIG. 4A in which like elements of FIG. 4 are provided having like reference designations, the mobile reader vehicle 50 is traveling along lane 52*d* in the road 52. The antenna is coupled to a mobile reader (not visible in FIG. 4) which is also disposed in (or on) the mobile reader vehicle 50. As shown in FIG. 4, an antenna system is used which allows the antenna beam to be directed to read transponders in vehicles which are located to the left (e.g. vehicle 61*a*), behind (e.g. vehicle 61*b*) or to the right (e.g. vehicle 61*c*) of the mobile reader vehicle 50. Thus, the antenna can be mounted or operated for a right-side read, a left side read or a behind the vehicle read.

It should be noted in FIG. 4A that the mobile reader vehicle 50 is proximate a plurality of vehicles 61*a*-61*e* each having transponders disposed therein. In such a transponder rich environment, it is desirable for the MER to include the ability to have the read zone (i.e. the zone or range or spatial region covered by the MER system) be either manually or automatically adjustable such that the MER can be adjusted to read/detect only transponders of interest.

In FIG. 4A, for example, if it is desired for the MER in vehicle 50 to read the transponder in vehicle 61*b*, it may be necessary to adjust the read range of the MER to ensure that the transponder in vehicle 61*d* is not inadvertently read by the MER. Dynamically adjusting the MER detection zone allows the MER to either read transponders several vehicles (or several lanes away) or to limit the detections to near vehicles (e.g. adjacent vehicles only) or near lanes (e.g. adjacent lanes).

As shown in FIG. 4A, the reference numeral 56*b* corresponds to a first read zone of the MER. Alternatively, however, the read zone may also have the shape and range defined by reference numeral 56*b*'. Thus, in this case, both the shape and the range of the read zone has been adjusted. Those of ordinary skill in the art will know how to adjust the size and shape of the read zone. The particular manner in which read zone characteristics may be adjusted depend upon a variety of factors including but not limited to the type of antenna being used and the type of detection scheme utilized in the MER.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. A mobile enforcement reader (MER) disposed in a vehicle, the MER for reading signals from a transponder and the MER comprising:

an antenna configured to receive signals in a plurality of different antenna receive directions with at least two of the plurality of antenna receive directions being orthogonal to each other;

a reader coupled to receive signals from said antenna; and a control/display unit (CDU) coupled to said reader and in response to signals from said reader, said CDU provides an output signal having information concerning the transponder, said CDU for selecting one of the plurality of different antenna receive directions and for processing transponder signals provided thereto from said reader wherein, said reader reads from the transponder: a Transponder ID; a location of the last toll point; a time of the last toll point that data was collected from; and agency data including the agency and vehicle classification, wherein at least one of the plurality of different antenna receive directions is a direction which is substantially orthogonal to a direction of travel of the vehicle in which the MER is disposed.

2. The MER of claim 1 wherein said CDU provides a visual indication of a direction of a detection zone.

3. The MER of claim 1 wherein in response to said reader reading agency data including the agency and vehicle classification, the reader processes the date to determine if transponder agency data is on an approved agency list.

4. The MER of claim 1 further comprising an exception list processor and wherein in response to said reader reading the transponder ID, said exception list processor compares the transponder ID to an exception list comprising a list of transponder IDs.

5. The MER of claim 1 further comprising a transponder class data store.

6. The MER of claim 5 wherein the transponder class data store has stored therein a value indicating that the MER belongs to one or more of a plurality of classes in a transponder classification scheme.

7. A mobile enforcement reader (MER) for reading signals from a transponder, the MER disposed in a vehicle and the MER comprising:

an antenna;

a reader coupled to receive signals from said antenna;

a control/display unit (CDU) coupled to said reader and in response to signals from said reader, said CDU provides an output signal having information concerning the transponder, said CDU for selecting an antenna receive direction and for processing transponder signals provided thereto from said reader wherein, said reader reads from the transponder: a Transponder ID; a location of the last toll point; a time of the last toll point that data was collected from; and agency data including the agency and vehicle classification; and a dynamic read zone circuit for adjusting at least one of a size and a shape of a MER read zone wherein said CDU is adapted to select at least one of a plurality of receive directions wherein at least one of the plurality of receive directions is a direction which is orthogonal to a direction of travel of the vehicle.

8. The MER of claim 7 wherein the dynamic read zone circuit is provided as a MER squelch circuit.

9. A mobile enforcement reader (MER) coupled to a first, law-enforcement vehicle and configured to read signals from a toll transponder coupled to a second vehicle, the MER comprising:

an antenna;

a reader coupled to receive signals from the antenna; and a control/display unit (CDU) coupled to the reader and configured to provide an output signal comprising information associated with the transponder in response to signals comprising toll data from the reader, the CDU being configured to allow selection of an antenna receive direction to receive the signals from the transponder and to process transponder signals provided by the reader, wherein the reader reads the signals from the transponder comprising:

a transponder ID;

a location of the last toll point;

a time of the last toll point that data was collected from; and agency data comprising an agency and vehicle classification, wherein the antenna comprises: a first antenna configured to receive signals emanating from a first direction corresponding to a direction which is toward a rear of the first vehicle and along a central longitudinal axis of the vehicle; and a second antenna configured to receive signals emanating from a second direction which is substantially orthogonal to the central longitudinal axis of the first vehicle.

10. The MER of claim 9, further comprising a third antenna configured to receive signals emanating from a third direction which is substantially orthogonal to a central longitudinal axis of the first vehicle and which is substantially opposite the second direction.

11. The MER of claim 9 wherein the selection of an antenna receive direction comprises selection of at least one of the first antenna or the second antenna and the CDU provides a visual indication corresponding to the selection.

12. The MER of claim 9 further comprising an exception list processor and wherein in response to the reader reading the transponder ID, the exception list processor is configured to compare the transponder ID to an exception list comprising a list of transponder IDs.

13. The MER of claim 9 wherein in response to the reader reading agency data including an agency classification and a vehicle classification, the reader processes the date to determine if transponder agency data is on an approved agency list.

14. The MER of claim 9, further comprising a dynamic read zone circuit configured to adjust at least one of a size and a shape of a MER read zone, the dynamic read zone circuit being provided as a MER squelch circuit.

15. The MER of claim 9, further comprising a transponder class data store is configured to store a value indicating that the MER belongs to one or more of a plurality of classes in a transponder classification scheme.

16. The MER of claim 9 wherein said CDU further comprises a direction selector coupled to said antenna, said direction selector adapted to select a direction from which the antenna receives signals such that a user can select to monitor for enforcement/verification purposes a vehicle to the left, right or behind the first, law-enforcement vehicle.

17. The MER of claim 16 wherein said CDU further comprises a display which provides a visual indication of a selected direction from which the MER receives signals.

* * * * *